United States Patent [19]

Sudnishnikov et al.

[11] 3,978,931

[45] Sept. 7, 1976

[54] AIR-OPERATED DRILLING MACHINE OR ROTARY-PERCUSSIVE ACTION

[76] Inventors: Boris Vasilievich Sudnishnikov, Krasny Prospekt, 56, kv. 59; Veniamin Viktorovich Kamensky, ulitsa Derzhavina, 19, kv. 70; Eduard Petrovich Varnello, ulitsa Dzerzhinskogo, 3, kv. 19; Sergei Konstantinovich Tupitsin, ulitsa Zorge, 123, kv. 31; Boris Vladimirovich Nazarov, ulitsa Meditsinskie kadry, 4, kv. 18, all of Novosibirsk, U.S.S.R.

[22] Filed: Oct. 30, 1975

[21] Appl. No.: 627,033

[52] U.S. Cl. ..... 175/99; 175/106; 173/110

[51] Int. Cl.[2] ..... E21B 1/06

[58] Field of Search ..... 175/92, 97–99, 175/101, 103, 105, 106, 230, 322; 173/110, 113, 146, 109, 104

[56] References Cited

UNITED STATES PATENTS

| | | | |
|---|---|---|---|
| 984,386 | 2/1911 | Morimura | 175/322 X |
| 1,489,319 | 4/1924 | Goldschmidt | 173/110 X |
| 3,899,033 | 8/1975 | Huisen | 175/106 X |

*Primary Examiner*—Ernest R. Purser
*Assistant Examiner*—Richard E. Favreau
*Attorney, Agent, or Firm*—Haseltine, Lake & Waters

[57] ABSTRACT

The machine has a braking arrangement for retaining it against rearward motion and rotation and includes a housing accommodating therein a hammer reciprocable in operation of the machine and adapted to strike the head part of the housing, the latter having a drilling tool rigidly connected thereto. The tail part of the housing supports a sleeve rigidly connected with the braking arrangement. The housing and the sleeve are connected so that the housing is rotatable and axially displaceable relative to the sleeve. The drilling tool rotating mechanism is positioned intermediate the sleeve and the housing and includes a helicoidal couple made up by a helicoidally threaded rod rigidly secured to the housing and a nut, the mechanism further including a freewheeling clutch of which the movable cage is made integral with the nut. Upon the hammer having delivered a blow upon the housing, the tool connected with the latter recoils from the rock of the face of the hole, this recoil driving the tool together with the housing rearwardly from the face, whereby the housing cooperates with the rotating mechanism, and the tool is rotated.

The invention is intended to utilize the effort of the recoil of the tool, as it strikes the face of the hole, for rotation of the drilling tool.

1 Claim, 3 Drawing Figures

AIR-OPERATED DRILLING MACHINE OR ROTARY-PERCUSSIVE ACTION

The present invention relates to drilling machines of percussive action and, more particularly, it relates to air-operated drilling machines of rotary-percussive action.

For the purposes of drilling hard rock there are widely employed drill rigs with down-the-hole air hammers. The air hammer with a drilling bit are mounted at the end of a string of tubes which is lowered into the hole together with the air hammer. Under the action of compressed air the air hammer makes its drilling bit strike the face of the borehole and break the rock which is carried away in the stream of compressed air directed to the face for this purpose. Feeding of the air hammer toward the face of the hole and rotation of the drilling bit jointly with the air hammer, which are necessary for the drilling operation, are effected by the drill rig with the aid of the drill string. Should the drilling bit become worn out or defective, the bit is replaced, which involves withdrawing the air hammer from the borehole and disassembling the string of the drill tubes. With the drilling bit replaced, the air hammer assembly is lowered once again into the hole, with the drill string being re-assembled.

Although having numerous assets, these machines are, however, not free from drawbacks. The bulky and costly drill rig impairs the use of such machines in areas and terrains with obstructed access, in places where mobile drilling equipment is needed. Besides, when such machines are employed for drilling deep holes, quite a lot of time is wasted on replacement of worn out or defective drilling bits. Such replacement is performed quite often, because in operation the bit is pressed against the face of the hole with a relatively great feed effort exerted upon the drill string by the drill rig and is to be rotated in this abutting condition, which speeds up the wearing out of the bit. On the other hand, the rapid wear of the drilling bits increases the overall drilling costs, on account of the high cost of the bits.

It is impossible to speed up the drilling operation performed by such machines by increasing the number of simultaneously operating air hammers, because several air hammers cannot be operated simultaneously from a single drill rig of this type.

The above drawbacks can be overcome with the help of a self-propelling down-the-hole drilling machine operating without a drill rig. This type of machines is known, but such machines can be used for drilling exclusively in rock of low to medium hardness. This type of machines cannot be used for drilling hard rock, because the machines do not incorporate an arrangement for rotating the drilling tool. To perform drilling in hard rock, a self-propelling down-the-hole machine has to incorporate a tool-rotating mechanism which should be sufficiently reliable in operation.

At present, there are widely known in-built tool-rotating mechanisms in perforating drills. Such a perforating drill includes a housing receiving therein a hammer member dividing the internal space of the housing into two working chambers, viz. the front and rear ones, and an air distributing mechanism. The air distributing mechanism alternatingly connects the two working chambers with the compressed air source and the atmosphere.

Under the action of the pressure of the compressed air in the working chambers the hammer reciprocates axially of the housing, delivering successive blows upon the tail of the drill rod supporting the drilling bit on the opposite end thereof, the tail of the drill rod being situated in the head portion of the housing.

Rotation of the drill rod is effected by a mechanism in-built within the housing of the perforating drill. The mechanism effecting rotation of the drill rod with the bit thereon is actuated by the motion of the hammer of which the head portion is in the form of a helicoidally threaded stud engaging a corresponding helicoidal nut which is at the same time the hub of a freewheeling clutch. The pawls of the free-wheeling clutch are arranged so that during the forward motion of the hammer, i.e. the motion toward the face, the hub of the wheel rotates, whereas during the rearward or return stroke of the hammer the hub is retained against rotation, whereby the hammer itself rotates. The rotary motion is transmitted to the drill rod via a coupling having a spline connection with the hammer at one its end and a connection with the tail portion of the drill rod at the opposite end, the tail portion being of a hexagonal shape. Thus, during its forward stroke the hammer rotates the hub of the freewheeling clutch and ends its stroke by striking the tail of the drill rod with the drilling bit, whereas during its rearward stroke the hammer rotates itself and transmits its rotation via the coupling to the drill rod supporting the drilling bit. Compressed air is supplied to the machine via a flexible hose. In operation the actuating part of the perforating air drill is outside the hole and is retained against rotation and rearward motion, as well as fed to the face either by the feed mechanism or manually, whereby the drilling bit practically continuously engages the rock of the face. When moving through its forward stroke, the hammer strikes the rod, and the drilling bit breaks up the rock, the broken-up pieces being carried away from the hole by the stream of compressed air supplied through a central passage in the drill rod. With the hammer moving through its rearward stroke the drilling bit is rotated. In this way the abovedescribed perforating drill performs every operation required for rotary-percussive drilling.

A major disadvantage of the abovedescribed perforating drill is the fact that the drilling bit is continuously pressed against the face with a considerable feed effort, whereby the bit is subjected to rapid abrasion wear, since it is rotated in the hole without disengagement from the face. This fact reduces the drilling depth per one bit and results in repeated replacement of worn-out bits, which increases the overall drilling costs on account of the high cost of the drilling bits. Besides, the tool rotating mechanism in the abovedescribed perforating drill operates on the principle of power takeoff from the hammer, which is undesirable, because the machine is usually of a small size and its power resources are limited.

It is an object of the present invention to create an air-operated drilling machine of a rotary-percussive action, which should enable to utilize the nonproductive recoil energy for rotation of the tool.

It is another object of the present invention to create a machine which should provide for prolonging the life of the drilling tool.

These and other objects are attained in an air-operated drilling machine of rotary-percussive action comprising an arrangement for retaining the machine in the course of a drilling operation from rearward motion and rotation, the machine including a housing receiving therein a hammer member defining with the housing a rear working chamber and a front working chamber, the hammer being reciprocable under the action of compressed air and adapted to strike a drilling tool situated in the head part of the housing, the machine further comprising a drilling tool rotating mechanism including a helicoidal couple with a helicoidally threaded rod and a nut, as well as a freewheeling clutch of which the movable cage is integral with either member of the helicoidal couple, and a device for removing slime sludge from the hole. In accordance with the invention, the machine incorporates a sleeve adjoining the tail part of the housing, the latter being connected with the sleeve for rotation and axial displacement relative thereto, the drilling tool being rigidly secured on the housing, and the tool rotating mechanism being situated intermediate the sleeve and the housing.

As an outcome of the present invention, there has been created a down-the-whole air-operated drilling machine of rotary-percussive action, providing for utilization of the nonproductive recoil energy for rotation of the drilling tool, so that no hammer energy is wasted on this rotation. Considering the limited power capacities of machines of this kind, the above feature presents an essential asset. Furthermore, the life of the drilling tool is prolonged, owing to the tool being rotated practically out of engagement with the face of the hole.

The present invention will be further described in connection with an embodiment thereof, with reference being had to the accompanying drawings, wherein.

Figure 1:
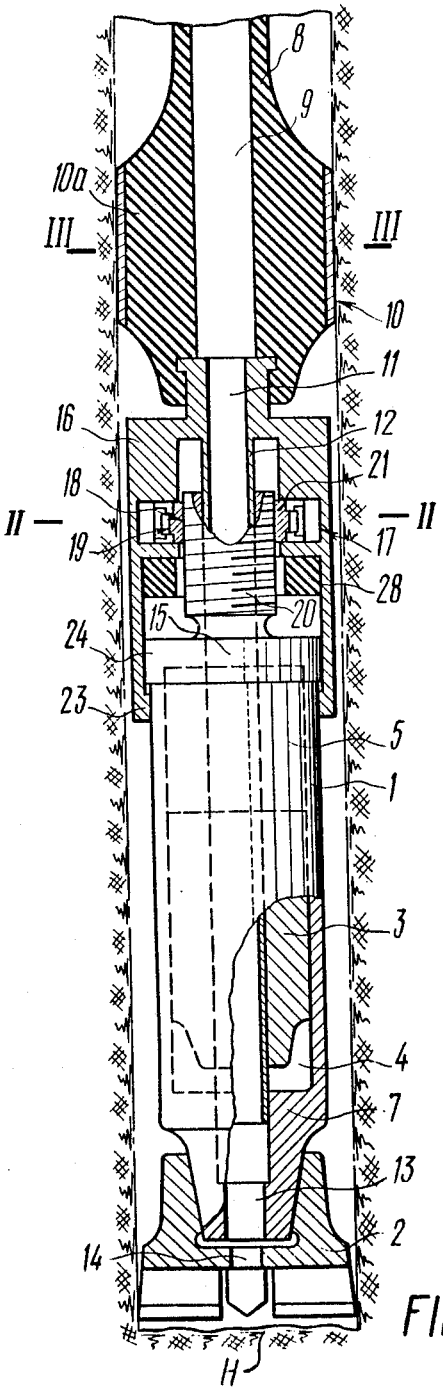
FIG. 1 is a longitudinally sectional view of an air-operated drilling machine of rotary-percussive action, in accordance with the invention.

Referring to the drawings, the machine includes a housing 1 with a drilling tool 2 secured thereon. The housing 1 receives therein a hammer 3 dividing the internal space of the housing into a front working chamber 4 and a rear working chamber 5. Under the action of the pressure differential created by means of an air distributing system (the system forming no part of the present invention and being of any known suitable kind, whereby it is neither illustrated in the drawing nor described hereinbelow) the hammer reciprocates inside the housing 1, repeatedly striking the front part 7 thereof. Compressed air is supplied to the machine via a flexible hose 8 connected to a source of compressed air, via the internal space 9 of the braking arrangement 10 and the internal passage 11 of a pipe 12 which extends through the machine, wherefrom compressed air passes through a passage 13 in the front part 7 of the housing 1 and a passage 14 in the drilling tool 2 to purge the face H of the borehole.

The housing 1 has its tail part 15 movably accommodated in a sleeve 16 rigidly connected with the braking arrangement 10. There is mounted internally of the sleeve 16, between the sleeve and the tail part 15 of the housing 1, a tool rotating mechanism 17 including a helicoidally threaded couple 18 and a freewheeling clutch 19. The helicoidally threaded couple 18 is made up by a helicoidally threaded rod 20 integral with the tail part 15 of the housing 1 and a helicoidal nut 21.

The nut 21 is made integral with the toothed wheel of the freewheeling clutch 19, so that the freewheeling clutch 19 is made up by the toothed wheelnut 21 and pawls 22 mounted on the body of the sleeve 16. The sleeve 16 has an internal annular shoulder 23, while the tail part 15 of the housing 1 is provided with an external annular shoulder 24. The braking arrangement 10 includes an elastic bush **10*a* made of an elastomer, e.g. rubber and having two lugs 25 supporting thereon linings 26 of an abrasion-resistant material, so that spaces 27 are left between the lugs 25 and the internal wall of the borehole, which form channels for withdrawing the broken pieces of rock from the face H, jointly with the gaps left between the external surface of the machine and the wall of the borehole. A shock absorber 28 is provided for damping eventual impacts of the shoulder 24 of the tail part 15 of the housing 1 against the sleeve 16**, as the housing recoils from the face.

The machine operates, as follows. When the air supply hose 8 is connected to a compressed air source, air under pressure is fed to the machine via the internal space 9 of the bush **10*a* and the pipe 12 passing through the sleeve 16, the helicoidally threaded rod 20, the chamber 5, the hammer 3, the chamber 4 and the front part 7 of the housing 1. The action of compressed air tends to expand the oval-section space 9 into a circular one, whereby the lugs 25 of the bush 10*a* urge the linings 26 to the wall of the borehole, so that friction forces develop between the wall of the borehole and the linings 26**, which retain the operating machine in the borehole.

The air distributing device actuates the hammer 3. While reciprocating axially of the housing 1, the hammer 3 strikes the front part 7 of the housing, whereby the housing 1 with the drilling tool 2 supported thereby are driven toward the face of the borehole relative to the stationary sleeve 16 with the braking arrangement 10, the helicoidally threaded rod 20 of the housing 1 cooperating with the nut 21 and rotating it (in a counterclockwise direction in FIG. 2). The direction of the helicoidal thread and the position of the pawls 22 are selected so that with the housing 1 being driven with the tool 2 toward the face H, i.e. through the forward stroke, the nut 21 rotates freely, while the housing 1 with the tool 2 are not rotating, because their mass and moment of inertia are many times greater than those of the nut 21.

Following each impact of the hammer 3, the tool 2 acts upon the face H and breaks the rock. A purging blast of air is permanently directed upon the face via the air supply hose 8, the internal space 9 of the braking arrangement 10, the passage 11 in the pipe 12, the passage 13 in the front part 7 of the housing and the passage 14 in the drilling tool 2. The broken pieces are carried by the blast of compressed air from the hole through the gaps and spaces left between the wall of the borehole and the housing 1, the gaps between the borehole wall and the sleeve 16 and through the spaces 27 defined between the lugs 25 of the bush **10*a*** and the borehole wall. Upon completion of the forward stroke, the hammer is driven in the housing through a return stroke.

Upon having struck the rock of the borehole face, the bit of the tool 2 recoils, whereby the tool 2 is driven in a direction opposite to its motion to the face.

Meanwhile, the hammer 3 is being driven in the housing 1 by the pressure of compressed air, controlled by the air distributing device of the machine, which means that the forward stroke of the housing 1 with the tool 2 is initiated by the impact of the hammer 3 against the front part 7 of the housing 1, whereas the return stroke of the housing 1 with the tool 2 is effected by the energy of recoil of the tool 2 from the rock of the face H.

Figure 2:
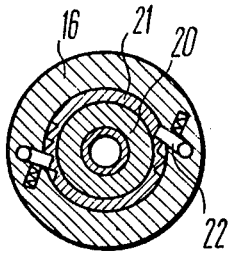
FIG. 2 is a sectional view taken on line II—II of FIG. 1.
Figure 3:
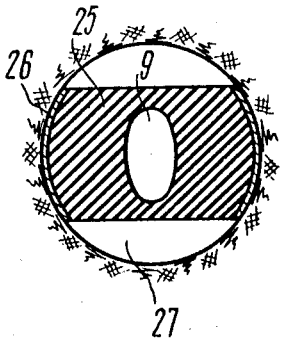
FIG. 3 is a sectional view taken on line III—III of FIG. 1.

During the return stroke of the housing 1 the helicoidal rod 20 tends to rotate the nut 1 (clockwise in FIG. 2). However, the direction of the helicoidal thread and the arrangement of the pawls 22 would not let the nut 21 rotate in this direction, whereby the entire housing 1 with the rod 20 and the tool 2 are rotated relative to the braking arrangement 10, to the sleeve 16 and the nut 21, which are stationary in the borehole.

Thus, during the return stroke of the housing 1 of the machine, caused by the recoil energy, the tool 2 is rotated through a predetermined angle. This rotation is effected with the tool disengaged from the face, which considerably facilitates such rotation.

The motion of the machine in the hole in the drilling direction is effected by the shoulder 24 of the housing 1 striking the shoulder 23 of the sleeve 16, the effort thus applied to the sleeve 16 and to the braking arrangement 10 substantially exceeding the friction forces developed by the braking arrangement 10.

This motion of the machine in the drilling direction is made possible by the housing 1 advancing axially within the sleeve 1, due to the tool 2 breaking up the rock of the face H.

Thus, the energy of the hammer 3 striking the front part of the housing 1 is utilized both for destructing the rock of the face and for advancing the machine.

The herein disclosed machine effects rotary-percussive drilling of hard rock, utilizing the recoil energy to rotate the rock-breaking tool.

What is claimed is:

1. An air-operated drilling machine of rotary-percussive action, incorporating an arrangement for retaining the machine in operation from rearward motion and rotation, the machine comprising: a housing; a drilling tool accommodated on the head part of said housing and rigidly secured thereto; a hammer received within said housing and defining therewith a front working chamber and a rear working chamber, adapted for reciprocation under the action of compressed air and for effecting percussive action onto said drilling tool; a sleeve adjoining the tail portion of said housing, the latter being connected with said sleeve for rotation and axial displacement relative thereto; a mechanism for rotating said drilling tool, situated intermediate said sleeve and said housing; means for carrying away slime sludge from the borehole being drilled; said drilling tool rotating mechanism including a helicoidal couple with a helicoidally threaded rod rigidly secured to the tail part of said housing and a nut, and a freewheeling clutch of which the movable cage is made integral with said nut; so that with said hammer delivering a blow upon said drilling tool, the latter strikes against the rock of the face of the borehole and recoils therefrom, whereby said tool with said housing and said helicoidally threaded rod are driven rearwardly from the face, in which way rotation of said drilling tool is effected.

* * * * *